United States Patent [19]

A-Yan

[11] Patent Number: 4,707,873

[45] Date of Patent: Nov. 24, 1987

[54] DOWN QUILT

[76] Inventor: Kuo A-Yan, 8-1 Fu Chung Road, 8 Lin Yushow Lee, Panchiao, Taipei Hsien, Taiwan

[21] Appl. No.: 754,408

[22] Filed: Jul. 12, 1985

[30] Foreign Application Priority Data

Aug. 14, 1984 [JP] Japan ..... 59-123695[U]

[51] Int. Cl.[4] ..... A47G 9/02

[52] U.S. Cl. ..... 5/502; 5/448; 383/48; 383/61; 383/904

[58] Field of Search ..... 5/502, 500, 482, 448; 383/61, 48, 904; 53/524; 2/253

[56] References Cited

U.S. PATENT DOCUMENTS 2,574,931 11/1951 Nason ..... 383/61
3,998,304 12/1976 Eagerton et al. ..... 383/61
4,112,556 9/1978 Flaum et al. ..... 383/61
4,426,945 1/1984 A-Yan ..... 112/420

FOREIGN PATENT DOCUMENTS 624701 8/1961 Canada ..... 383/904
1023202 1/1958 Fed. Rep. of Germany ..... 5/434
1948172 10/1978 Fed. Rep. of Germany ..... 5/502

*Primary Examiner*—Alexander Grosz
*Attorney, Agent, or Firm*—Schwartz & Weinrieb

[57] ABSTRACT

A down quilt in which a tubular closure section is provided on an opening in the quilt through which a feather feeder nozzle is inserted. A first fastener is provided at the opening and a second fastener is provided on the closure section so that feathers supplied into the interior of the quilt are prevented from escaping through the opening, whereby the quality of the down quilt can be maintained for a long time.

1 Claim, 5 Drawing Figures

DOWN QUILT

FIELD OF THE INVENTION

This invention relates to a down quilt filled with feathers and, more particularly, to such a down quilt in which an opening through which a feather feeder nozzle is inserted is closed with a plurality of fasteners.

BACKGROUND OF THE INVENTION

A down quilt is formed by sewing together the edges of a front cloth and a back cloth and also providing seam lines in a checkerboard-like fashion to define a plurality of sections in order that the feathers remain uniformly distributed in the quilt at all times. A down quilt of such a structure is disclosed in Japanese Patent Publication No. SHO 56-1094.

The inventor has proposed a method of manufacturing a down quilt, as disclosed in U.S. Pat. No. 4,426,945, in which the feather feeder nozzle insertion opening is improved to permit supply of feathers to each section readily and reliably.

However, this patent makes no disclosure of means for closing the feather feeder nozzle insertion opening provided in the down quilt.

Usually, the feather feeder nozzle insertion opening is closed by sewing it with thread after the feathers have been supplied to the quilt interior of the quilt.

However, even where the feather feeder nozzle opening is closed by sewing with thread or with a slide fastener, fine feathers will get out through the closed feather feeder nozzle insertion opening and come in contact with the skin of the user, making the user uncomfortable. Further, feather gradually find their way out of the closed feather feeder nozzle insertion opening, gradually reducing the amount of feathers remaining in the quilt, so that, eventually, the down quilt is no longer usable.

OBJECT OF THE INVENTION

An object of the invention is to provide a down quilt, in which an opening through which a feather feeder nozzle is inserted into the interior can be readily and reliably closed so that feathers cannot get out through the opening and the quality of the down quilt can be maintained for a long time.

SUMMARY OF THE INVENTION

To attain the above object of the invention, there is provided a down quilt of the type in which a front side cloth and a back side cloth are sewn together along their edges and are also sewn with seam lines in a checkerboard-like fashion to define a plurality of feather sections and an opening is formed by a portion of the edges which are not sewn together, through which a feather feeder nozzle is to be inserted into the interior of the quilt, and which is provided with a tubular closure section with one open end united to the edge of the feather feeder nozzle insertion opening and capable of being accommodated in the interior of the quilt and taken out of the same, the opening being closed by a plurality of fasteners provided at the opening and on the closure section. Since the feather feeder nozzle insertion opening is closed by a plurality of fasteners, feather cannot escape from the interior of the down quilt, and the quality of the down quilt can be maintained by retaining a sufficient quantity of feathers therein for a long time.

BRIEF DESCRIPTION OF THE DRAWINGS

The above and other objects and features of the invention will become more apparent from the detailed description thereof when the same is read with reference to the accompanying drawings, in which.

DESCRIPTION OF THE PREFERRED EMBODIMENT

Figure 1:
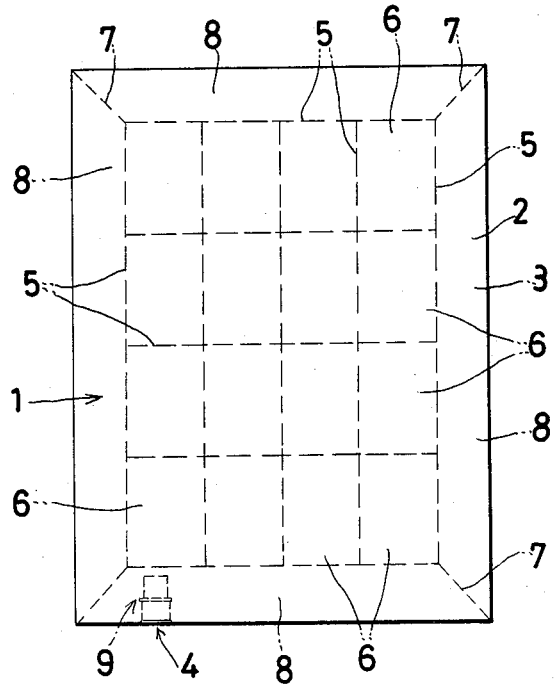
FIG. 1 is a schematic plan view showing an embodiment of the down quilt according to the invention.
Figure 2:
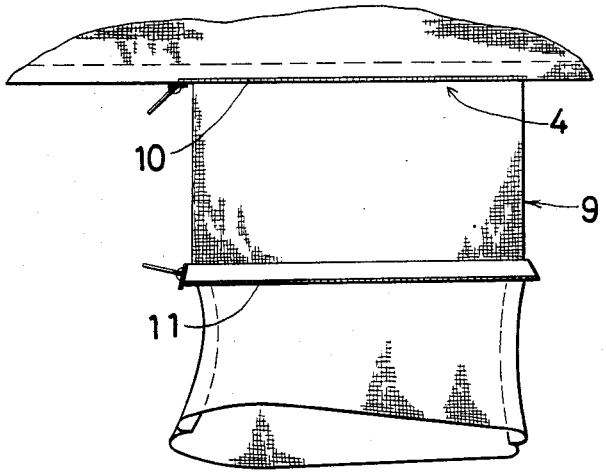
FIG. 2 is an enlarged-scale plan view showing the same down quilt with a closure section taken out through a feather feeder nozzle insertion opening.
Figure 3:
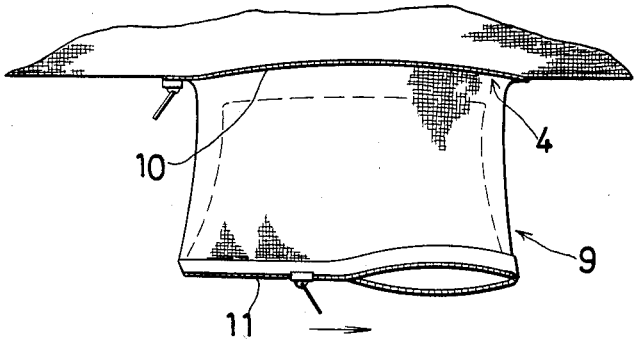
FIG. 3 is an enlarged-scale plan view showing the down quilt with a second fastener closed.
Figure 4:
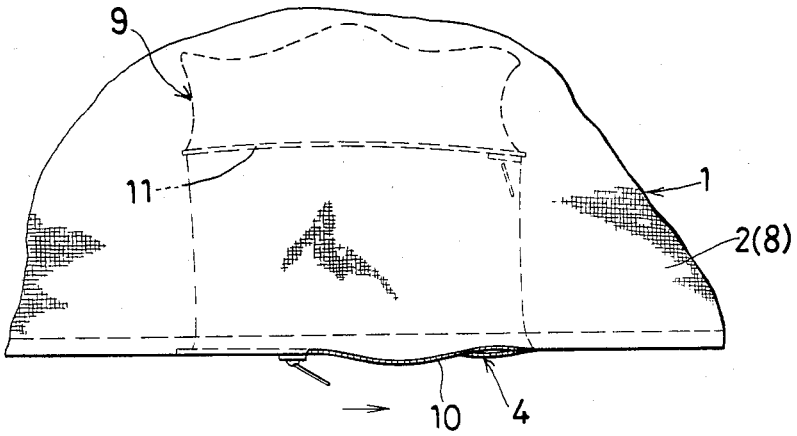
FIG. 4 is an enlarged-scale plan view showing a first fastener closed.

Now, an embodiment of the invention will be described with reference to the drawings. Referring to the drawings, a down quilt is shown, which comprises front and rear cloths 2 and 3 with the edges thereof sewn together with thread into the form of a sack. An opening 4 is formed by a portion of the edges which are not sewn together. The interior of the quilt 1 is divided by longitudinal and transverse seam lines 5 into a plurality of sections 6. The quilt 1 further has diagonal seam lines 7 defining four edge sections 8 extending along the respective edges of the quilt. The sections 6 and 8 partially communicate with one another so that a feather feeder nozzle inserted into the quilt through the opening 4 can be inserted into each section for supplying feathers to each section to thereby obtain the down quilt. The down quilt of this structure, and the method of manufacturing the same, are the same as proposed earlier by the inventor in U.S. Pat. No. 4,426,945, so they are not described in further detail. A closure section 9 is connected to the opening 4. The closure section 9 is made of cloth and is of a flat tubular form open at opposite ends. One open end of the closure section 9 is sewn to the inner edge of the opening 4. The closure section 9 thus can be accommodated in the quilt and taken out of the same.

Figure 5:
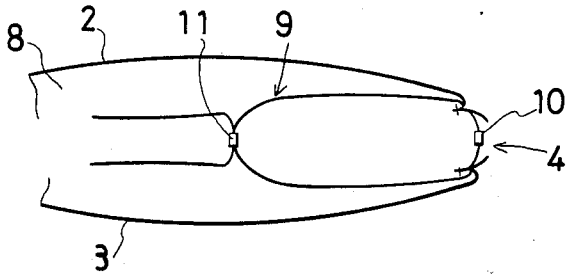
FIG. 5 is a schematic sectional view showing the down quilt shown in FIG. 4.

The opening 4 is provided with a first fastener 10, and the closure section 9 is provided with a second fastener 11. In this embodiment, the first and second fasteners 10 and 11 are slide fasteners. The second fastener 11 may be provided at the open end of the closure section 9 or at an intermediate portion thereof in the length direction thereof such that the second slide fastener 11 is free from contact with the feathers within the quilt, as seen in FIG. 5, whereby the feathers cannot escape from the quilt due to the fact that the feathers cannot pass through the enclosed second slide fastener 11.

The first fastener 10 may be sewn to the opening 4 of the quilt together with the closure section 9. The second fastener 11 may be sewn in advance to the surface of the closure section 9. The first and second fasteners 10 and 11 are not limited to slide fasteners, and it is possible to utilize buttons or surface fasteners. Furthermore, two or more fasteners may be provided on the closure section 9 as the second fastener 11, for instance at the open end of the closure section 9 and at an intermediate portion thereof in the length direction.

To fill the down quilt as described above with feathers, the feather feeder nozzle is inserted into each of the sections 6 and 8 through the closure section 9 and opening 4. Feathers are then supplied to each section. Thereafter, the closure section 9 is taken out from the opening 4, and the second fastener 11 provided on the closure section 9 is closed. Then, the closure section 9 is accommodated in the interior of the quilt 1 through the opening 4, and the first fastener 10 is closed.

The opening 4 is thus doubly closed by the first and second fasteners 10 and 11. If a plurality of second fasteners are provided on the closure section 9, the opening 4 can be closed triply, quadruply, or more times. When opening the opening 4, the first fastener 10 is opened, the closure section 9 is taken out of the quilt, and the second fastener 11 is opened.

As has been described, according to the invention, the opening of the down quilt, through which the feather feeder nozzle is inserted into the quilt, is provided with a closure section capable of being accommodated in the quilt and taken out of the same, and the closure section may be provided with a multi-stage fasteners. Thus, it is possible to reliably prevent feathers supplied into the quilt from getting out of the same. The prescribed amount of feathers thus can be maintained in the quilt to maintain the quality of the quilt for a long time.

Obviously, many modifications and variations of the present invention are possible in light of the above teachings. It is therefore to be understood that within the scope of the appended claims, the present invention may be practiced otherwise than as specifically described herein.

What is claimed is:

1. A down quilt of the type in which a front side cloth and a back side cloth are sewn together along the peripheral edge region thereof and are also sewn with seam lines in a checkerboard fashion so as to define a plurality of feather-holding sections, and in which an opening is formed within a portion of said peripheral edge region which is not sewn together and through which opening a feather feeder nozzle can be inserted into the interior of said quilt, comprising:

a tubular closure section with one open end connected to said peripheral edge region of said quilt defining said opening and capable of being entirely accommodated within said interior of said quilt when said interior of said quilt has been filled with said feathers and withdrawn from said interior of said quilt when it is desired to fill said interior of said quilt with said feathers;

a first slide fastener provided upon said peripheral edge region of said quilt defining said opening for closing said opening and providing a continuum of said peripheral edge region of said quilt, and for opening said opening so as to permit said withdrawal of said closure section from said interior of said quilt; and a second slide fastener provided upon said closure section, at an intermediate portion of said closure section as viewed in the lengthwise direction of said closure section, for opening and closing said closure section, whereby said second slide fastener is free from contact with said feathers disposed interiorly within said quilt so as to prevent the passage of said feathers through said second slide fastener and out from said quilt.

* * * * *